US011359537B1

(12) United States Patent
Gastaldi

(10) Patent No.: US 11,359,537 B1
(45) Date of Patent: Jun. 14, 2022

(54) SPARK IGNITION ENGINE, PRE-CHAMBER, AND METHOD FOR COOLING A PRE-CHAMBER

(71) Applicant: SAUDI ARABIAN OIL COMPANY, Dhahran (SA)

(72) Inventor: Patrick Gastaldi, Rueil-Malmaison (FR)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/363,930

(22) Filed: Jun. 30, 2021

(51) Int. Cl.

| | |
|---|---|
| ***F02B 19/10*** | (2006.01) |
| ***F02B 19/12*** | (2006.01) |
| ***F01P 3/16*** | (2006.01) |
| ***F02F 1/24*** | (2006.01) |
| ***F02F 1/40*** | (2006.01) |

(52) U.S. Cl.
CPC ..... *F02B 19/1009* (2013.01); *F01P 3/16* (2013.01); *F02B 19/12* (2013.01); *F02F 1/242* (2013.01); *F02F 1/40* (2013.01)

(58) Field of Classification Search
CPC combination set(s) only.
See application file for complete search history.

(56) References Cited

U.S. PATENT DOCUMENTS 4,170,979 A * 10/1979 Latsch ..... F02B 19/1009 123/260
4,875,445 A * 10/1989 Imoto ..... F02B 19/18 123/292
4,899,707 A * 2/1990 Matsuura ..... F02B 19/165 123/270
4,926,817 A * 5/1990 Imoto ..... F02B 19/18 123/292
5,067,458 A * 11/1991 Bailey ..... F02B 19/14 123/292
9,567,896 B2 * 2/2017 Pouring ..... F02B 23/08
9,617,908 B2 * 4/2017 Willi ..... F02B 19/1009
2013/0000596 A1 * 1/2013 Diaz ..... F02B 19/14 123/25 A
2014/0209057 A1 * 7/2014 Pouring ..... F02B 19/1023 123/257
2015/0083058 A1 * 3/2015 Becker ..... F02F 1/242 123/41.29
2015/0211410 A1 * 7/2015 Saville ..... F02M 53/043 123/41.52

(Continued)

FOREIGN PATENT DOCUMENTS

| | | |
|---|---|---|
| CN | 106930819 A | 7/2017 |
| JP | H02112613 A | 4/1990 |
| JP | 2007138909 A | 6/2007 |

*Primary Examiner* — Kevin R Steckbauer
(74) *Attorney, Agent, or Firm* — Osha Bergman Watanabe & Burton LLP

(57) ABSTRACT

A spark ignition engine includes: a pre-chamber (PC); a main chamber (MC); and a cylinder head coupled with a water jacket. The PC includes: a spark plug; and a PC body. The spark plug is surrounded by a jacket with thermal-conductive substance. The thermal-conductive substance is solid at room temperature and liquid at working temperature of the PC. At working temperature of the PC, the liquid thermal-conductive substance conducts heat from the spark plug to the water jacket. The PC body is coated with a layer of non-thermal-conductive substance.

9 Claims, 3 Drawing Sheets

(56) References Cited

U.S. PATENT DOCUMENTS

| | | | | |
|---|---|---|---|---|
| 2016/0169180 | A1* | 6/2016 | McAlister | F02M 51/0603 123/472 |
| 2016/0333771 | A1* | 11/2016 | Willi | F02B 19/1009 |
| 2019/0078498 | A1 | 3/2019 | Bedogni et al. | |
| 2019/0323415 | A1 | 10/2019 | Corrigan et al. | |
| 2020/0165960 | A1 | 5/2020 | Takada | |
| 2020/0165962 | A1 | 5/2020 | Takada | |

* cited by examiner

SPARK IGNITION ENGINE, PRE-CHAMBER, AND METHOD FOR COOLING A PRE-CHAMBER

BACKGROUND

High efficiency spark ignition engines are often equipped with a pre-chamber (PC) that operates at very high temperature. The efficiency of the spark ignition engine is highly dependent on the thermal efficiency of the PC. Meanwhile, certain components of the PC must be cooled to avoid overheating.

SUMMARY

In one aspect, the invention relates to a spark ignition engine comprising: a pre-chamber; a main chamber (MC); and a cylinder head coupled with a water jacket, wherein the PC comprises: a spark plug; and a PC body, wherein the spark plug is surrounded by a jacket with thermal-conductive substance, wherein the thermal-conductive substance is solid at room temperature and liquid at working temperature of the PC, wherein, at working temperature of the PC, the liquid thermal-conductive substance conducts heat from the spark plug to the water jacket, and wherein the PC body is coated with a layer of non-thermal-conductive substance.

In one aspect, the invention relates to a PC of a spark ignition engine, the PC comprising: a spark plug; and a PC body, wherein the spark plug is surrounded by a jacket with thermal-conductive substance, wherein the thermal-conductive substance is solid at room temperature and liquid at working temperature of the PC, wherein, at working temperature of the PC, the liquid thermal-conductive substance conducts heat from the spark plug to the water jacket, and wherein the PC body is coated with a layer of non-thermal-conductive substance.

In one aspect, the invention relates to a method for cooling a spark ignition engine, wherein the spark ignition engine comprises: a PC; a MC; and a cylinder head coupled with a water jacket, and wherein the PC comprises: a spark plug; and a PC body. The method comprises: surrounding the spark plug with a jacket containing thermal-conductive substance; and coating the PC body with a layer of non-thermal-conductive substance, wherein the thermal-conductive substance is solid at room temperature and liquid at working temperature of the PC, and wherein, at working temperature of the PC, the liquid thermal-conductive substance conducts heat from the spark plug to the water jacket.

Other aspects and advantages of the invention will be apparent from the following description and the appended claims.

DETAILED DESCRIPTION

Figure 1:
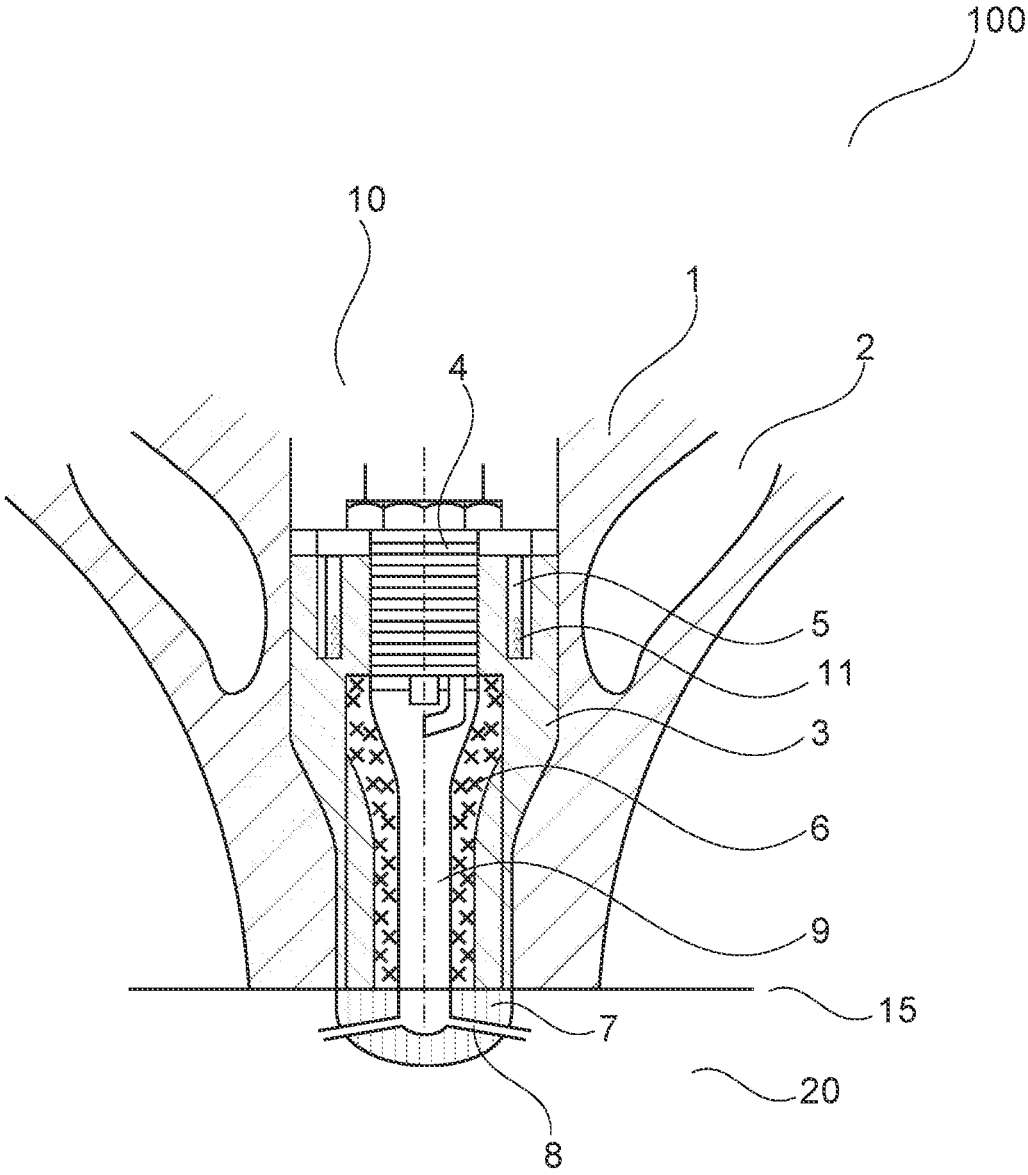
FIG. 1 shows the structure of a spark ignition engine in cross-section view in accordance with one or more embodiments.

Specific embodiments of the invention will now be described in detail with reference to the accompanying figures. Like elements in the various figures are denoted by like reference numerals for consistency. Like elements may not be labeled in all figures for the sake of simplicity.

In the following detailed description of embodiments of the invention, numerous specific details are set forth in order to provide a more thorough understanding of the invention. However, it will be apparent to one of ordinary skill in the art that the invention may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers does not imply or create a particular ordering of the elements or limit any element to being only a single element unless expressly disclosed, such as by the use of the terms "before," "after," "single," and other such terminology. Rather, the use of ordinal numbers is to distinguish between the elements. By way of an example, a first element is distinct from a second element, and the first element may encompass more than one element and succeed (or precede) the second element in an ordering of elements.

In the following description of FIGS. 1-3, any component described with regard to a figure, in various embodiments of the invention, may be equivalent to one or more like-named components described with regard to any other figure. For brevity, descriptions of these components will not be repeated with regard to each figure. Thus, each and every embodiment of the components of each figure is incorporated by reference and assumed to be optionally present within every other figure having one or more like-named components. Additionally, in accordance with various embodiments of the invention, any description of the components of a figure is to be interpreted as an optional embodiment which may be implemented in addition to, in conjunction with, or in place of the embodiments described with regard to a corresponding like-named component in any other figure.

It is to be understood that the singular forms "a," "an," and "the" include plural referents unless the context clearly dictates otherwise. Thus, for example, reference to "a horizontal beam" includes reference to one or more of such beams.

Terms such as "approximately," "substantially," etc., mean that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

It is to be understood that, one or more of the steps shown in the flowcharts may be omitted, repeated, and/or performed in a different order than the order shown. Accordingly, the scope of the invention should not be considered limited to the specific arrangement of steps shown in the flowcharts.

Although multiple dependent claims are not introduced, it would be apparent to one of ordinary skill that the subject matter of the dependent claims of one or more embodiments may be combined with other dependent claims.

A spark ignition engine is a complex system. When the spark ignition engine operates, combustion occurs in one or more chambers, which are structured in the form of a housing where fuel gets burned and releases heat. PC is one form of the chambers commonly used in spark ignition engines. During operation, the internal temperature of a PC could be very high.

To improve fuel efficiency, it is typically desirable to reduce the heat loss from the PC. Therefore, the body (e.g., walls) of a PC is often made of materials with very low thermal conductivity for insulation. However, some components of the spark ignition engine such as the spark plug, which is physically coupled to the PC body, need to be cooled to avoid overheating. There is thus a need for cooling the spark plug while maintaining thermal efficiency inside the PC. One or more embodiments of the invention are made in view of this need.

FIG. 1 shows the structure of a spark ignition engine 100 in accordance with one or more embodiments. Note that only parts that are particularly relevant to the embodiments are shown while the remaining are omitted.

In FIG. 1, the spark ignition engine 100 includes a cylinder head 1, a PC 10, and a main chamber 20. The PC 10 and the MC 20 are separated by an interface 15.

The PC 10 includes a spark plug 4 and a PC body 3. The spark plug 4 may be disposed at one end of the PC 10 opposite to the interface 15 and may be physically coupled to the PC body 3. Note that FIG. 1 only shows the portion of the spark plug 4 that is adjacent to the PC while the rest of the spark plug is not shown.

The cylinder head 1 includes a water jacket 2. While the water jacket 2 may contain water or other coolant used for cooling the spark ignition engine 100 in general, the water jacket 2 cannot be automatically used to directly cool the spark plug 4 due to structural limitation. Instead, there is a thermal path along which the heat from the spark plug 4 flows and eventually dissipates in the coolant.

To create this thermal path, one or more embodiments use a jacket 5 filled with a thermal-conductive substance 11 to surround the spark plug 4. For efficient and effective cooling, the thermal-conductive substance 11 is chosen to be solid at room temperature and liquid at the working temperature of the PC 10. Because the phase change from solid to liquid absorbs a large amount of heat, the "two-phase cooling" achieved by the thermal-conductive substance 11 is very effective in cooling the spark plug 4 when the PC 10 operates and creates a large amount of heat. The liquid thermal-conductive substance 11 then flows toward the water jacket 2 to conduct the heat away from the spark plug 4. Examples of the thermal-conductive substance 11 include sodium and sodium/potassium, which are solid at room temperature and become liquid at around 90° C.

For cooling efficiency, the jacket 5 surrounding the spark plug 4 is either in contact with the spark plug 4 or within a small distance from the spark plug 4. To avoid undesired heat loss from inside the PC 10, the dimension of the jacket 5 is carefully designed. In the example shown in FIG. 1, the spark plug 4 includes a thread extending in the vertical direction along with the axis of the PC body 3, and the jacket 5 is designed such that it does not extend beyond the lowest level of the thread. This design is helpful for ensuring that the cooling of the spark plug 4 does not undermine with the thermal insulation on the inner space 9 of the PC 10.

To further protect the insulation, the inner surface of the PC body 3 is coated with a layer of non-thermal-conductive substance 6. Examples of the non-thermal-conductive substance 6 include ceramic and zirconia, which could achieve a thermal conductivity of less than 25 W/mK. This layer improves insulation efficiency of inner space 9 of the PC 10 and thus reduces heat loss from the combustion.

The PC 10 further includes a PC cap 7 disposed at the interface 15 between the PC 10 and the MC 20. The PC cap 7 has a plurality of holes 8 that connect the inner space 9 of the PC 10 to the MC 20 so that gas may flow from the PC 10 into the MC 20. The PC cap 7 is made of thermal-conductive material in order to keep its temperature low enough to avoid pre-ignition in the MC 20. The PC cap 7 forms a thermal bridge with the PC body 3 so the heat on the PC cap 7 may be conducted to the cylinder head 1 and absorbed by, e.g., the water jacket 2.

Figure 2:
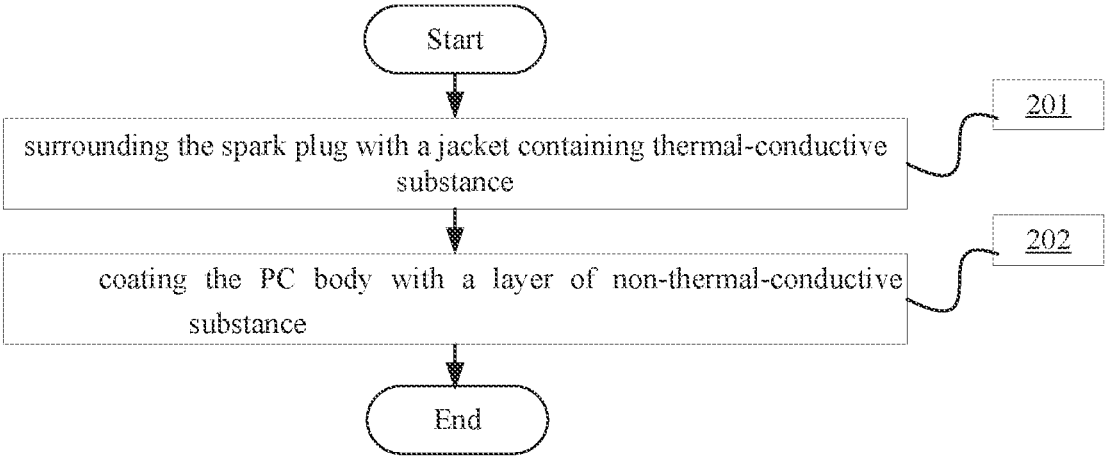
FIG. 2 is a flowchart of a method for cooling a spark ignition engine in accordance with one or more embodiments.

FIG. 2 is a flowchart of a method for cooling a spark ignition engine in accordance with one or more embodiments. At steps 201, the spark plug is surrounded by a jacket containing thermal-conductive substance. At steps 202, the PC body is coated with a layer of non-thermal-conductive substance. The features in the embodiments described in reference to FIG. 1, such as the materials of the thermal-conductive substance and the non-thermal-conductive substance, the design of the jacket, and the structure of the spark plug, may also be applicable to the method described in reference to FIG. 2. Note that steps 201 and 202 do not necessarily have to take place in the order as they are described. It is possible that step 202 takes place before or at the same time as step 201 in some embodiments.

Figure 3:
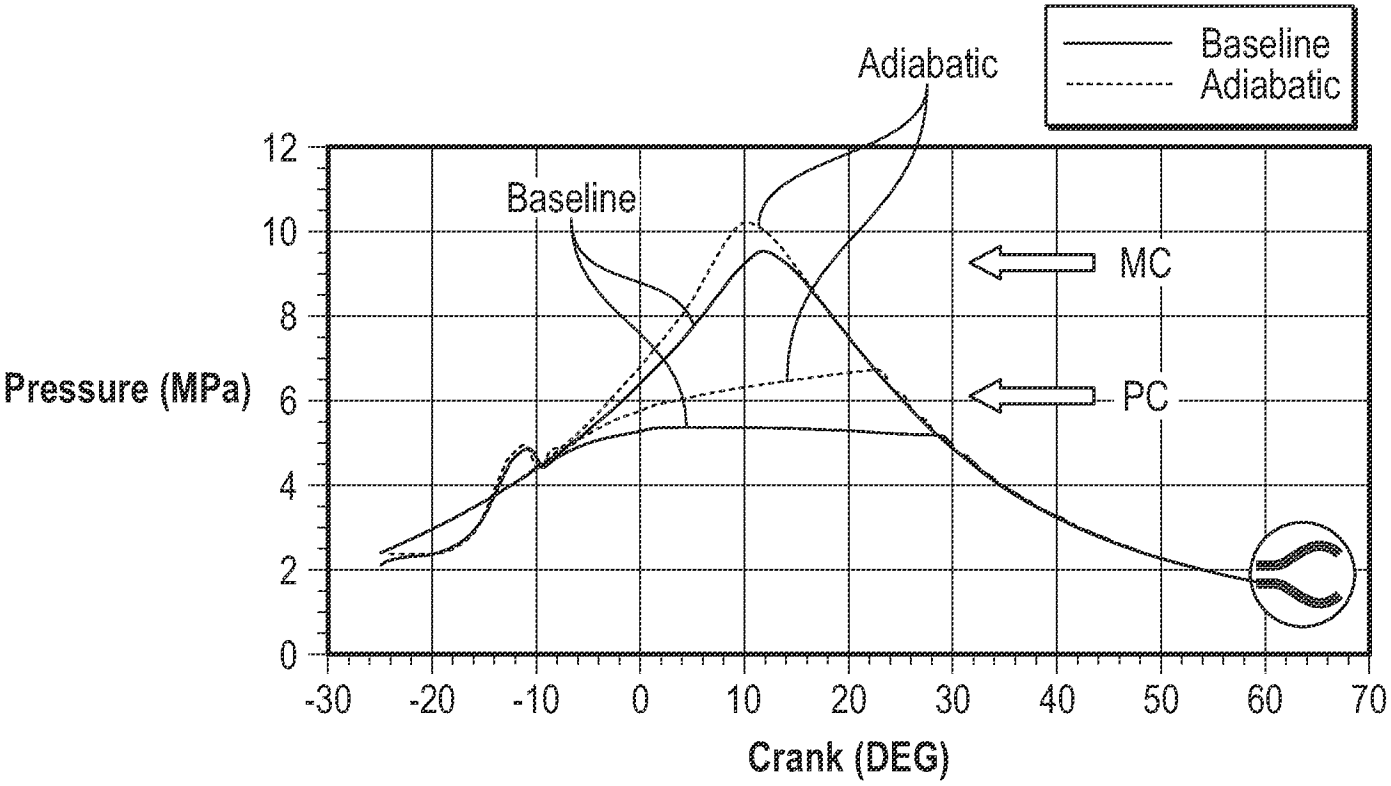
FIG. 3 shows the simulation results of insulation effect under a baseline configuration and under a configuration implementing the insulation features of one or more embodiments.

FIG. 3 shows simulation results comparing the adiabatic performance between a baseline configuration, i.e., without the insulating features of the embodiments described above, and a configuration with the insulating features. The results were obtained assuming the amounts of injected fuel are the same for the two configurations. In FIG. 3, the horizontal axis represents the crank angle, which corresponds to the time base during an engine cycle. The vertical axis represents the pressure. There are four curves in total shown in FIG. 3. The upper two represent the performance of the MC and the lower two represent the performance of the PC.

As can be seen from the curves, the configuration with the insulating features (the curves labeled "adiabatic") results in higher pressure inside the PC than the baseline configuration (the curves labeled "baseline"), indicating higher temperature inside the PC, which in turn results in higher pressure and temperature in the MC and higher efficiency. The simulation results thus demonstrate that good thermal insulation performance is achieved by the embodiments of the invention.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A spark ignition engine comprising: a pre-chamber (PC); a main chamber (MC); and a cylinder head coupled with a water jacket, wherein the PC comprises: a spark plug; and a PC body, wherein the spark plug is surrounded by a jacket with thermal-conductive substance, wherein the thermal-conductive substance is solid at room temperature and liquid at working temperature of the PC, wherein, at working temperature of the PC, the liquid thermal-conductive substance conducts heat from the spark plug to the water jacket, wherein the PC body is coated with a layer of non-thermal-conductive substance, wherein the spark plug comprises a thread extending in a direction along an axis of the PC body, wherein the jacket surrounds the spark plug in the direction along the axis, and wherein the jacket does not extend beyond a lowest level of the thread in the direction along the axis.

2. The spark ignition engine according to claim 1, wherein the PC further comprises a PC cap disposed at an interface between the PC and the MC, wherein the PC cap comprises a plurality of holes that connect an inner space of the PC to the MC.

3. The spark ignition engine according to claim 2, wherein the PC cap is thermal-conductive and forms a thermal bridge with the PC body.

4. A pre-chamber (PC) of a spark ignition engine, the PC comprising: a spark plug; and a PC body, wherein the spark plug is surrounded by a jacket with thermal-conductive substance, wherein the thermal-conductive substance is solid at room temperature and liquid at working temperature of the PC, wherein, at working temperature of the PC, the liquid thermal-conductive substance conducts heat from the spark plug to the water jacket, wherein the PC body is coated with a layer of non-thermal-conductive substance, wherein the spark plug comprises a thread extending in a direction along an axis of the PC body, wherein the jacket surrounds the spark plug in the direction along the axis, and wherein the jacket does not extend beyond a lowest level of the thread in the direction along the axis.

5. The PC according to claim 4, further comprising a PC cap disposed at an interface between the PC and a main chamber (MC) of the spark ignition engine, wherein the PC cap comprises a plurality of holes that connect an inner space of the PC to the MC.

6. The PC according to claim 5, wherein the PC cap is thermal-conductive and forms a thermal bridge with the PC body.

7. A method for cooling a spark ignition engine, wherein the spark ignition engine comprises: a pre-chamber (PC); a main chamber (MC); and a cylinder head coupled with a water jacket, and wherein the PC comprises: a spark plug; and a PC body, the method comprising:

surrounding the spark plug with a jacket containing thermal-conductive substance; and coating the PC body with a layer of non-thermal-conductive substance, wherein the thermal-conductive substance is solid at room temperature and liquid at working temperature of the PC, and wherein, at working temperature of the PC, the liquid thermal-conductive substance conducts heat from the spark plug to the water jacket, wherein the spark plug comprises a thread extending in a direction along an axis of the PC body, wherein the jacket surrounds the spark plug in the direction along the axis, and wherein the jacket does not extend beyond a lowest level of the thread in the direction along the axis.

8. The method according to claim 7, wherein the PC further comprises a PC cap disposed at an interface between the PC and the MC, wherein the PC cap comprises a plurality of holes that connect an inner space of the PC to the MC.

9. The method according to claim 8, wherein the PC cap is thermal-conductive and forms a thermal bridge with the PC body.

* * * * *